US008429816B2

(12) United States Patent
Spracher et al.

(10) Patent No.: US 8,429,816 B2
(45) Date of Patent: Apr. 30, 2013

(54) STATOR RING CONFIGURATION

(75) Inventors: David R. Spracher, Simpsonville, SC (US); Michael T. Hudson, Greenville, SC (US); Ronald Stuart Denmark, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1102 days.

(21) Appl. No.: 12/391,856

(22) Filed: Feb. 24, 2009

(65) Prior Publication Data

US 2010/0064516 A1 Mar. 18, 2010

Related U.S. Application Data

(60) Provisional application No. 61/096,597, filed on Sep. 12, 2008.

(51) Int. Cl.
*B21K 25/00* (2006.01)

(52) U.S. Cl.
USPC ..... 29/889.22; 29/889; 29/889.2

(58) Field of Classification Search ..... 29/889–889.61
See application file for complete search history.

(56) References Cited

U.S. PATENT DOCUMENTS

| | | | | |
|---|---|---|---|---|
| 4,925,365 | A | 5/1990 | Crozert et al. | |
| 5,104,288 | A | 4/1992 | Groenendaal, Jr. et al. | |
| 6,200,091 | B1 | 3/2001 | Bromann et al. | |
| 6,514,041 | B1 | 2/2003 | Matheny et al. | |
| 6,984,108 | B2 | 1/2006 | Anderson et al. | |
| 7,984,548 | B2 * | 7/2011 | Anderson et al. | 29/889.21 |
| 2008/0118352 | A1 | 5/2008 | Wheeler et al. | |
| 2008/0282541 | A1 | 11/2008 | Anderson et al. | |
| 2009/0041580 | A1 | 2/2009 | Wichmann et al. | |

FOREIGN PATENT DOCUMENTS

| | | |
|---|---|---|
| EP | 1772596 A2 | 11/2007 |
| EP | 1895107 A1 | 3/2008 |
| GB | 710869 | 6/1954 |

OTHER PUBLICATIONS

Great Britain Foreign Search Report dated Dec. 16, 2009 related to Application No. GB0915417.0.

* cited by examiner

*Primary Examiner* — Richard Chang
(74) *Attorney, Agent, or Firm* — Armstrong Teasdale LLP

(57) ABSTRACT

A stator ring for use in a compressor of a gas turbine engine and a method of assembling the stator ring are provided. The stator ring includes a first plurality of segments that includes a first segment including a first circumferential end formed with a first cut and a second circumferential end formed with a second cut that is complementary to the first cut, wherein the first plurality of segments are configured to be circumferentially-coupled together, and a second plurality of segments that includes a second segment including a first circumferential end with a third cut and a second circumferential end with a fourth cut that is complementary to the third cut, wherein the second plurality of segments are configured to be circumferentially-coupled together.

20 Claims, 10 Drawing Sheets

STATOR RING CONFIGURATION

This application claims the benefit of U.S. Provisional Application No. 61/096,597, filed Sep. 12, 2008, which is hereby incorporated by reference in its entirety.

BACKGROUND OF THE INVENTION

The present invention relates generally to gas turbine engines and, more particularly, to a unique stator ring configuration for use with gas turbine engines.

Some known compressors include a stator vane assembly that includes a plurality of stator vanes, each of which includes an airfoil that extends between adjacent rows of rotor blades. Some known stator vane assemblies include a plurality of stator rings, each of which are coupled to compressor casing circumferential slots. Some known stator rings include a plurality of segments that are circumferentially-coupled together. At least some known stator rings use identical segments.

Some known airfoils are associated with a series of natural frequencies. More specifically, the combination of the number of stator vanes and the rotational speed of the compressor may coincide with a natural frequency of the rotor blades, which may induce vibrational stresses. To facilitate avoiding the natural frequencies, and thus reduce vibrational stresses, some known gas turbine engines incorporate non-uniform vane spacing (NUVS). However, the various configurations of NUVS stator rings and individual segments require a specific order of assembly. Improper stator ring assembly may lead to high stresses and/or a failure of rotating airfoils, either of which may eventually lead to forced outages. Accordingly, the benefits derived from incorporating NUVS may be reduced or lost completely by misassembling the stator vane assemblies.

To facilitate properly assembling a NUVS stator vane assembly, some known stator rings incorporate more segments per stator ring or matching slots in the stator ring outer diameter with pins in the compressor casing. However, introducing these known embodiments, alone, did not effectively Murphy-proof assembling stator vane assemblies. Murphy-proofing, as used in the present application, is defined to mean modifying a device to facilitate reducing opportunities for error, misuse, or failure.

The present invention incorporates a unique stator ring configuration that facilitates Murphy-proofing the assembly process that is independent of previous embodiments and that easily retrofits into existing casings without modification.

BRIEF SUMMARY OF THE INVENTION

In one embodiment, a method for assembling a stator ring is provided. The method includes providing a first plurality of segments including a first segment that includes a first circumferential end formed with a first cut and a second circumferential end formed with a second cut that is complementary to the first cut, providing a second plurality of segments including a second segment that includes a first circumferential end formed with a third cut and a second circumferential end formed with a fourth that is complementary to the third cut, and circumferentially coupling the first plurality of segments to the second plurality of segments.

In another embodiment, a stator ring for use in a compressor is provided. The stator ring includes a first plurality of segments that includes a first segment including a first circumferential end formed with a first cut and a second circumferential end formed with a second cut that is complementary to the first cut, wherein the first plurality of segments are configured to be circumferentially-coupled together, and a second plurality of segments that includes a second segment including a first circumferential end with a third cut and a second circumferential end with a fourth cut that is complementary to the third cut, wherein the second plurality of segments are configured to be circumferentially-coupled together.

In yet another embodiment, a compressor for use in a gas turbine engine is provided. The compressor includes a compressor casing and a stator ring coupled to the compressor casing. The stator ring includes a first plurality of segments that includes a first segment including a first circumferential end formed with a first cut and a second circumferential end formed with a second cut that is complementary to the first cut, wherein the first plurality of segments are configured to be circumferentially-coupled together, and a second plurality of segments that includes a second segment including a first circumferential end with a third cut and a second circumferential end with a fourth cut that is complementary to the third cut, wherein the second plurality of segments are configured to be circumferentially-coupled together.

DETAILED DESCRIPTION OF THE INVENTION

The system and method described herein enables proper assembly of stator vane assemblies by incorporating segments that include strategically defined geometry on the circumferential ends.

Figure 1:
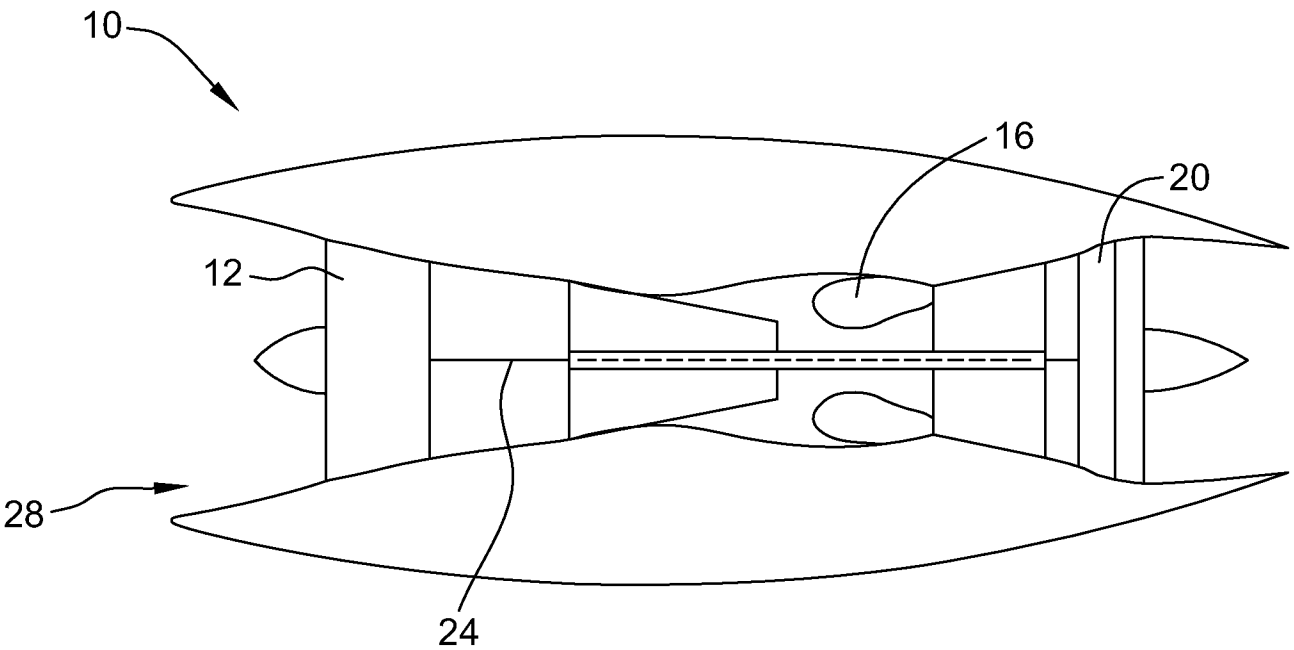
FIG. 1 is a schematic illustration of an exemplary gas turbine engine.

FIG. 1 is a schematic illustration of an exemplary gas turbine engine 10. Gas turbine engine 10 includes, in serial axial flow arrangement, a compressor 12, a combustor 16, and a turbine 20. Compressor 12 and turbine 20 are coupled to a drive shaft 24.

During operation, air 28 upstream of engine 10 flows into compressor 12, which compresses the air. Compressed air is channeled to combustor assembly 16, which mixes compressed air with fuel and ignites the fuel-air mixture. Combustion gas generated is channeled to turbine 20, which extracts mechanical rotational energy from the airflow and rotates drive shaft 24.

Figure 2:
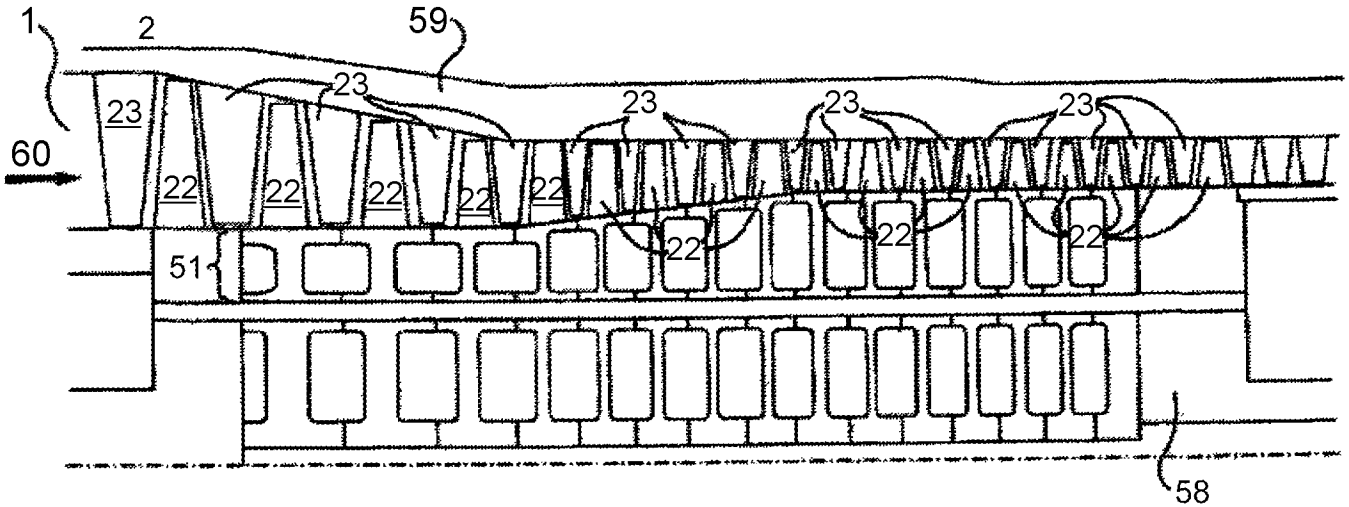
FIG. 2 is a schematic illustration of a known airflow path defined through multiple stages of the exemplary gas turbine engine shown in FIG. 1.

FIG. 2 is a schematic end view of a known air flow path 60 extending through multiple stages of compressor 12. In the exemplary embodiment, compressor 12 includes seventeen compressor stages. Notably, the present invention is not limited to any number of stages as the exemplary embodiment is not intended to limit the present invention in any manner.

Each stage of compressor 12 includes a plurality of circumferentially-spaced rotor blades 22 coupled to a rotor wheel 51 and a plurality of circumferentially-spaced stator vanes 23 coupled to a static compressor casing 59. Stator vanes 23 each include an airfoil (not numbered) that extends between adjacent rows of adjacent rotor blades 22. In the exemplary embodiment, rotor blades 22 extend radially outward from rotor wheel 51. A drive shaft 58 is coupled to rotor wheel 51. Stator vanes 23 and rotor blades 22 are positioned in air flow path 60.

During operation, drive shaft 58 drives rotor wheel 51. Rotor blades 22 cooperate with stator vanes 23 to impart kinetic energy to air flow path 60, which facilitates increasing air pressure within compressor 12.

Figure 3:
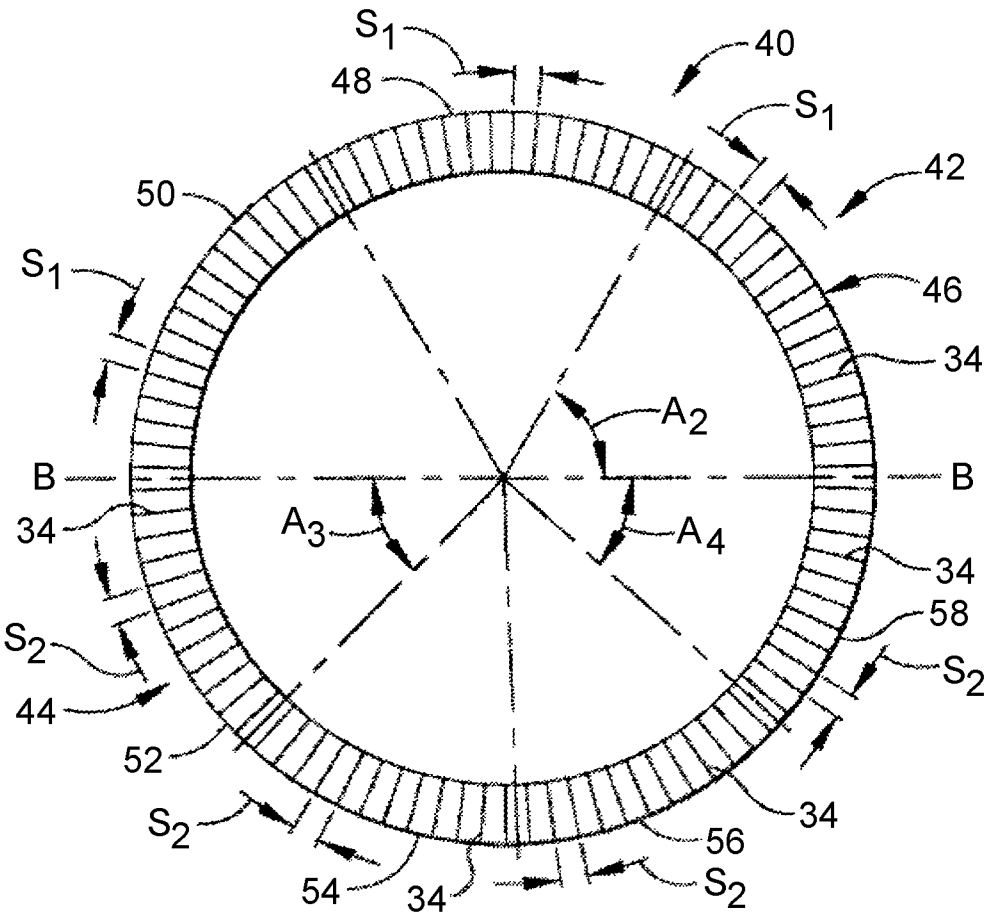
FIG. 3 (PRIOR ART)
FIG. 3 is a schematic end view of a known stator ring incorporating non-uniform vane spacing used with the exemplary gas turbine engine shown in FIG. 1.

FIG. 3 is a schematic end view of a known stator vane assembly 40 that incorporates non-uniform vane spacing (NUVS) within gas turbine engine 10. Compressor 12 defines an annular flow path and includes at least one rotor wheel 51 that includes a plurality of circumferentially-spaced rotor blades 22 extending radially outward. Stator vane assembly 40 is adjacent to, and downstream from, rotor wheel 51. In the exemplary embodiment, stator vane assembly 40 includes an upper half 42 and a lower half 44 that are divided along line B-B.

In the exemplary embodiment, upper half 42 includes three identical circumferentially-spaced segments 46, 48, and 50. Upper half segments 46, 48, and 50 each encompass a radial arc A2 of about 60°. In the exemplary embodiment, upper half segments 46, 48, and 50 each include sixteen circumferentially-spaced stator vanes 34 that are oriented with a substantially uniform pitch spacing S1 defined between each pair of circumferentially-adjacent stator vanes 34.

In the exemplary embodiment, lower half 44 includes four circumferentially-spaced segments 52, 54, 56, and 58. Lower half segments 52, 54, and 56 are identical and each encompasses a radial arc A3 of about 46°. In the exemplary embodiment, lower half segments 52, 54, and 56 each include twelve circumferentially-spaced stator vanes 34 with a substantially uniform pitch spacing S2 defined between each pair of circumferentially-adjacent stator vanes 34. Moreover, in the exemplary embodiment, lower half segment 58 encompasses a radial arc A4 of about 42° and includes eleven circumferentially-spaced stator vanes 34 with substantially uniform pitch spacing S2.

Accordingly, in the exemplary known embodiment, stator vane assembly 40 includes a total of ninety-five stator vanes 34 with upper half 42 having a pitch spacing S1 and lower half 44 having a pitch spacing S2 defined between each pair of circumferentially-adjacent stator vanes 34 about the circumference of stator vane assembly 40.

FIGS. 4-10 illustrate exemplary segments 82, 84, 86, and 88 that, as described in more detail below, include strategically defined geometries 62 and 64 on the circumferential ends of each segment 82, 84, 86, and 88 that facilitate properly assembling a stator ring assembly 80.

Figure 4:
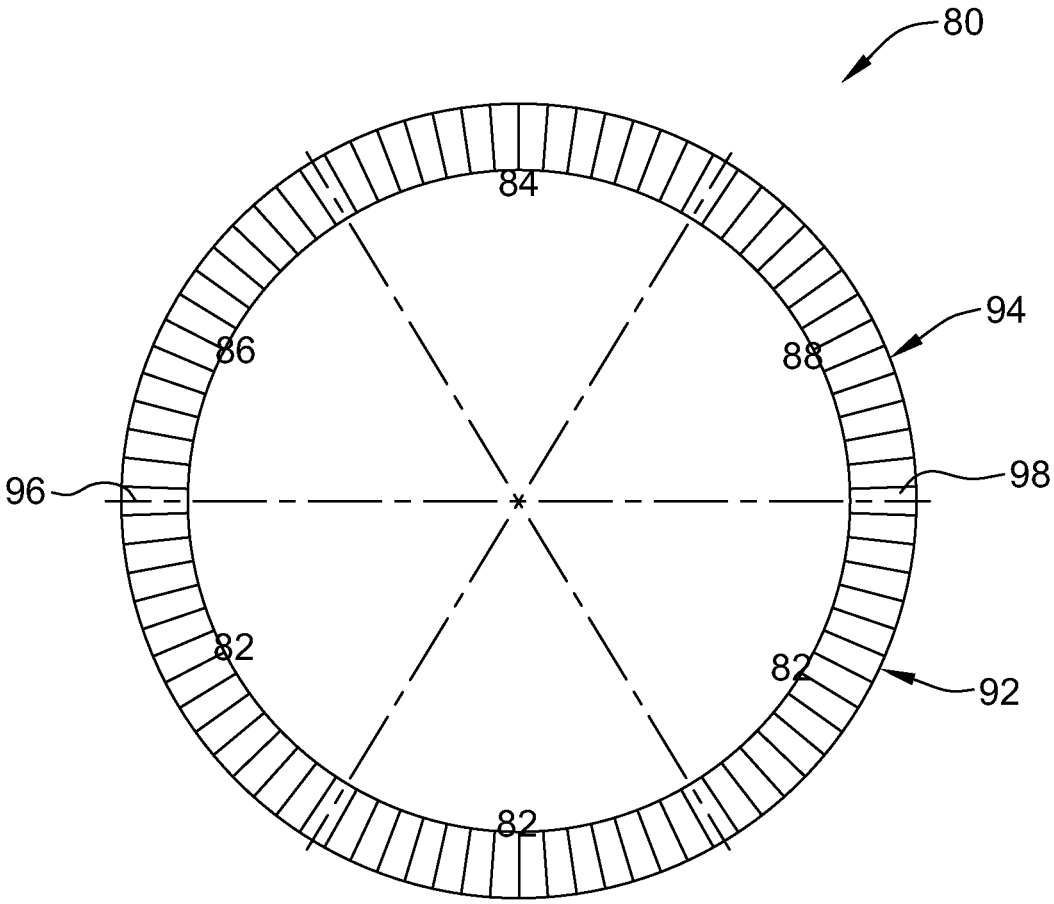
FIG. 4 is a schematic end view of an exemplary stator ring including a first plurality of segments incorporating a first strategically defined geometry on the circumferential ends and a second plurality of segments incorporating a second strategically defined geometry on the circumferential ends used with the exemplary gas turbine engine shown in FIG. 1.

FIG. 4 illustrates an exemplary stator ring assembly 80 that includes a lower half 92 and an upper half 94, wherein lower half 92 and upper half 94 are configured to couple at a first joint 96 and a second joint 98.

In the exemplary embodiment, lower half 92 includes a first plurality of segments 82 and upper half 94 includes a second plurality of segments 84, 86, and 88. First plurality of segments is also referred to as plurality of lower half segments 82, and second plurality of segments 84, 86, and 88 are also referred to as upper half segment 84 and coupling segments 86 and 88. Coupling segment 86 is positioned proximate to joint 96, and coupling segment 88 is positioned proximate to joint 98. In an alternative embodiment, upper half 94 includes a plurality of upper half segments 84 and coupling segments 86 and 88. In another alternative embodiment, lower half 92 includes at least one lower half segment 82 and coupling segment 86, and upper half 94 includes at least one upper half segment 84 and coupling segment 88. Notably, the present invention is not limited to any number of segments or sections, as the exemplary embodiment is not intended to limit the present invention in any manner.

Figure 5:
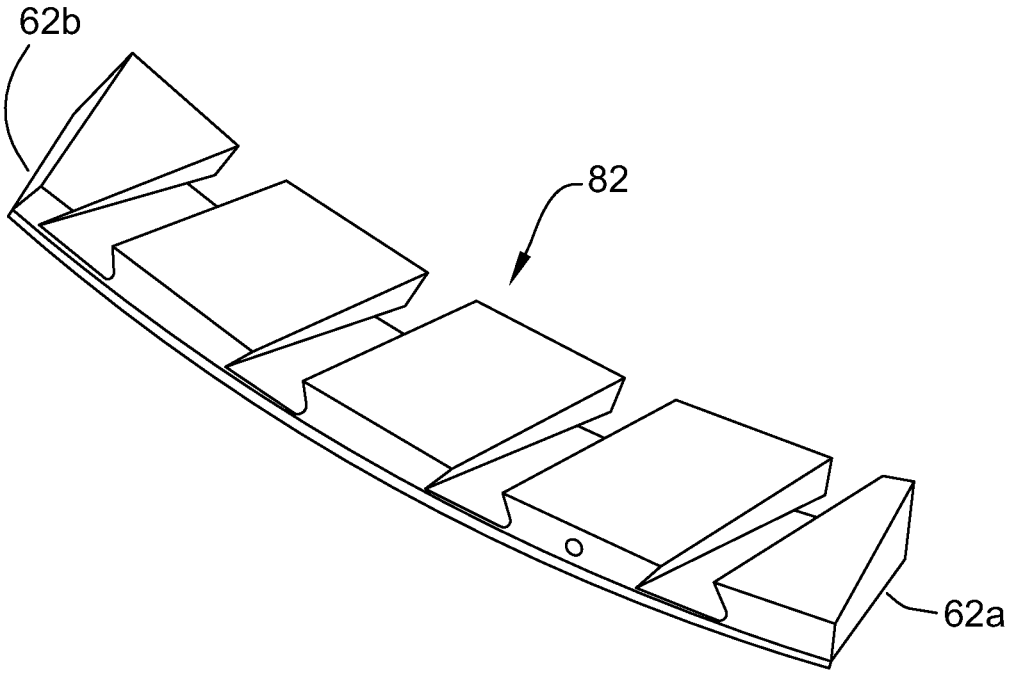
FIG. 5 is a perspective of an exemplary segment used with the first plurality of segments shown in FIG. 4.
Figure 6:
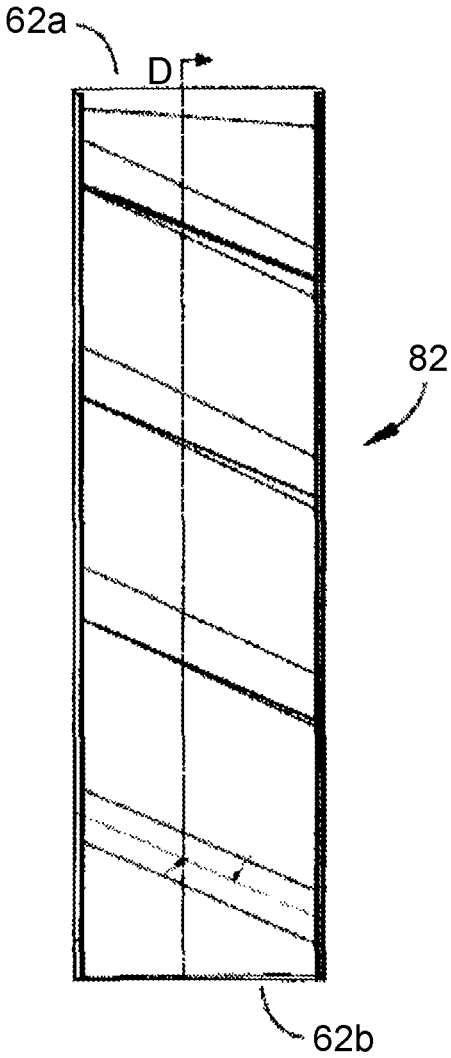
FIG. 6 is a plan view of the exemplary segment shown in FIG. 5.
Figure 7:
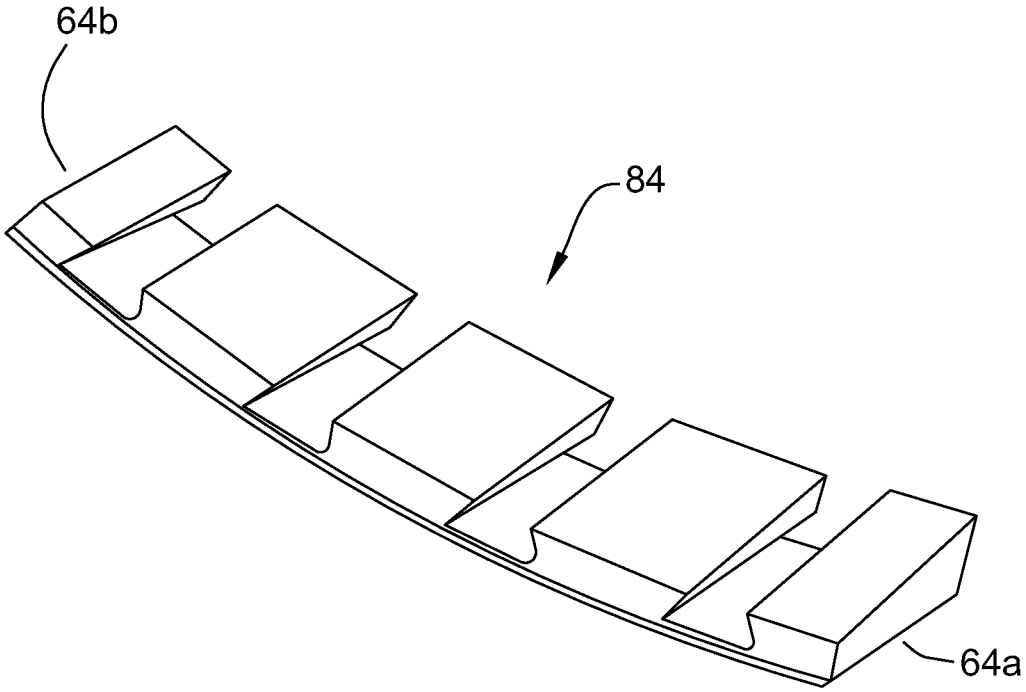
FIG. 7 is a perspective of an exemplary segment used with the second plurality of segments shown in FIG. 4.
Figure 8:
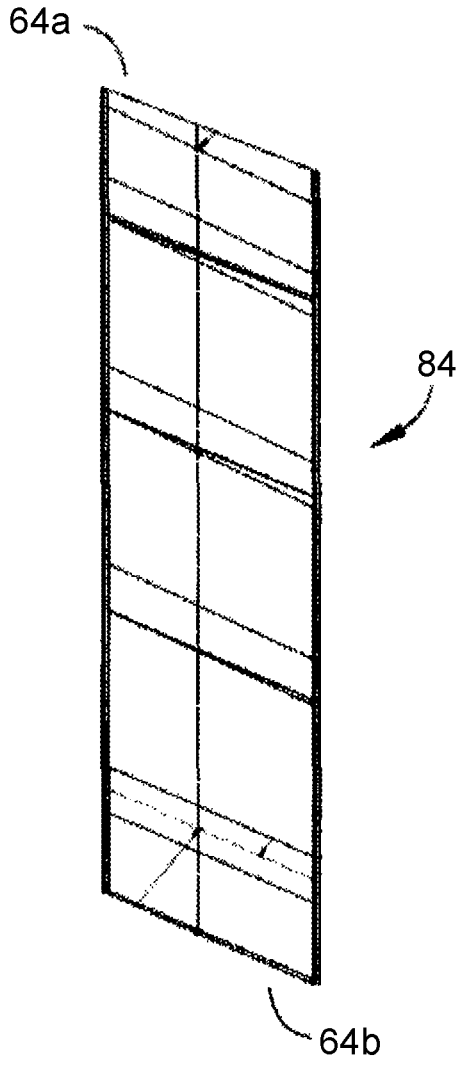
FIG. 8 is a plan view of the exemplary segment shown in FIG. 7.

FIGS. 5 and 6 illustrate exemplary lower half segment 82, and FIGS. 7 and 8 illustrate exemplary upper half segment 84. Lower half segment 82 includes a first circumferential end formed with a first cut 62*a* and a second circumferential end formed with a second cut 62*b* that is complementary to first cut 62*a*. Lower half segment 82 is configured to be circumferentially-coupled to other lower half segments 82. Upper half segment 84 includes a first circumferential end formed with a third cut 64*a* and a second circumferential end formed with a fourth cut 64*b* that is complementary to third cut 64*a*. Upper half segment 84 is configured to be circumferentially-coupled to other upper half segments 84. Notably, the present invention is not limited to any number of unique cuts, as the exemplary embodiment is not intended to limit the present invention in any manner.

In the exemplary embodiment, first cut 62*a* and second cut 62*b* are substantially similar and third cut 64*a* and fourth cut 64*b* are substantially similar. More specifically, in the exemplary embodiment, first cut 62*a* and second cut 62*b* are substantially perpendicular to an arcuate side 66 of lower half segment 82, and third cut 64*a* and fourth cut 64*b* are oblique relative to arcuate side 66 of upper half segment 84. Notably, the present invention is not limited to any unique cut, as the exemplary embodiment is not intended to limit the present invention in any manner, but rather may include any cut that facilitates reducing opportunities for error, misuse, or failure, including straight, angled, and step cuts.

Figure 9:
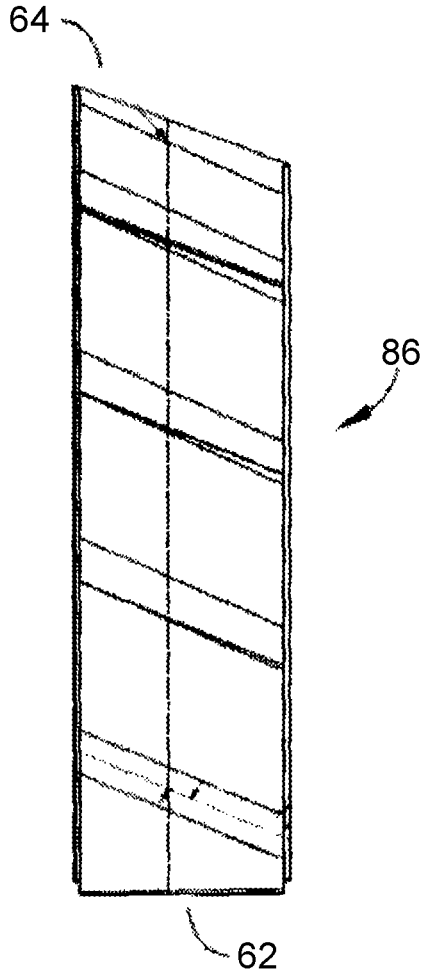
FIG. 9 is a plan view of a first exemplary coupling segment used to couple the first plurality of segments to the second plurality of segments shown in FIG. 4.
Figure 10:
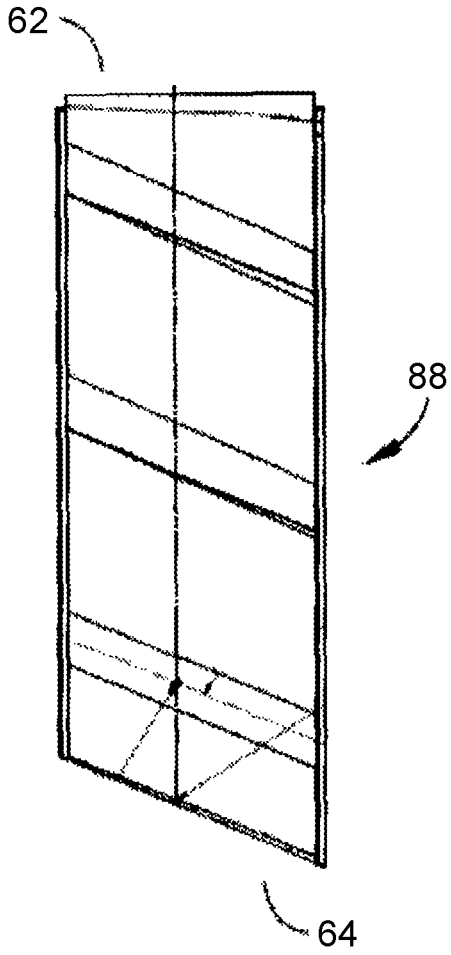
FIG. 10 is a plan view of a second exemplary coupling segment used to couple the first plurality of segments to the second plurality of segments shown in FIG. 4.

FIG. 9 illustrates exemplary coupling segment 86, and FIG. 10 illustrates exemplary coupling segment 88. As described above, coupling segments 86 and 88 are positioned proximate to joints 96 and 98, respectively, and each coupling segment 86 and 88 is configured to couple lower half 92 to upper half 94. As such, each coupling segment 86 and 88 includes at least one of first cut 62*a* and second cut 62*b*, which is configured to couple to lower half segment 82, and at least one of third cut 64*a* and fourth cut 64*b*, which is configured to couple to upper half segment 84.

In the exemplary embodiment, each coupling segment 86 and 88 includes a perpendicular end cut 62 and an oblique end cut 64, wherein perpendicular end cut 62 is configured to couple to lower half segment 82 and oblique end cut 64 is configured to couple to upper half segment 84.

The use of strategically defined geometries 62*a*, 62*b*, 64*a*, and 64*b* on the circumferential ends of segments 82, 84, 86, and 88 facilitates properly assembling stator ring 80 by preventing the installation of one segment with circumferential end cut 62 with another segment having circumferential end cut 64. For example, in the exemplary embodiment, segment 82 will not mate flush against segment 84 because of the respective different circumferential end cuts 62 and 64, resulting in a visible misalignment.

Moreover, because the use of strategically defined geometries 62*a*, 62*b*, 64*a*, and 64*b* is independent of the physical requirements of the compressor casing, changes to the compressor casing are not required to accommodate an installation of stator ring 80. Such physical requirements include, but are not limited to, vane quantity per segment, vanes spacing, segment quantity per stator ring half, and segment quantity per stator ring. As such, existing stator rings may be retrofitted without modification to the casing.

The methods, apparatus, and systems for a unique stator vane configuration described herein facilitate operation of a gas turbine engine. More specifically, the unique stator vane configuration facilitates assembling stator assemblies. Practice of the methods, apparatus, or systems described or illustrated herein is neither limited to a fuel nozzle bellows replacement nor to gas turbine engines generally. Rather, the methods, apparatus, and systems described or illustrated herein may be utilized independently and separately from other components and/or steps described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Although specific features of various embodiments of the invention may be shown in some drawings and not in others, this is for convenience only. In accordance with the principles of the invention, any feature of a drawing may be referenced and/or claimed in combination with any feature of any other drawing.

While the invention has been described in terms of various specific embodiments, those skilled in the art will recognize that the invention can be practiced with modification within the spirit and scope of the claims.

TABLE OF REFERENCE NUMERALS:

| | |
|---|---|
| 10 | Gas turbine engine |
| 12 | Compressor |
| 16 | Combustor |
| 20 | Turbine |
| 22 | Rotor blades |
| 23 | Stator vanes |
| 24 | Drive shaft |
| 28 | Air |
| 34 | Stator vanes |
| 40 | Stator vane assembly |
| 42 | Upper half |
| 44 | Lower half |
| 46, 48, 50 | Upper half segments |
| 51 | Rotor wheel |
| 52, 54, 56, 58 | Lower half segments |
| 59 | Static compressor casing |
| 60 | Air flow path |
| 62a | First cut (shape) |
| 62b | Second cut (shape) |
| 64a | Third cut (shape) |

-continued

TABLE OF REFERENCE NUMERALS:

| | |
|---|---|
| 64b | Fourth cut (shape) |
| 66 | Arcuate side |
| 80 | Stator ring assembly |
| 82 | Lower half segments |
| 84 | Upper half segments |
| 86 | First coupling segment |
| 88 | Second coupling segment |
| 92 | Lower half |
| 94 | Upper half |
| 96 | First joint |
| 98 | Second joint |

What is claimed is:

1. A method for assembling a stator ring, wherein said method comprises:

providing a first plurality of segments that include at least a first segment that includes a first end formed with a first shape and a second end formed with a second shape that is complementary to the first shape, wherein the first segment first and second ends are circumferentially-spaced apart;

providing a second plurality of segments that include at least a second segment wherein the second segment includes a first end formed with a third shape and a second end formed with a fourth shape that is complementary to the third shape, wherein the second segment first and second ends are circumferentially-spaced apart; and circumferentially coupling the first plurality of segments to the second plurality of segments, wherein each of the first, second, third, and fourth shapes facilitate Murphy-proofing the assembly of the stator ring.

2. The method for assembling a stator ring in accordance with claim 1, wherein said providing a first plurality of segments further comprises:

providing a first coupling segment that includes a first end formed with at least one of the third shape and the fourth shape and a second end formed with the second shape, wherein the first coupling segment first and second ends are circumferentially-spaced apart.

3. The method for assembling a stator ring in accordance with claim 2, wherein said providing a first plurality of segments further comprises:

providing a second coupling segment that includes a first end formed with the first shape and a second end formed with at least one of the third shape and the fourth shape, wherein the second coupling segment first and second ends are circumferentially-spaced apart.

4. The method for assembling a stator ring in accordance with claim 2, wherein said providing a second plurality of segments further comprises:

providing a second coupling segment that includes a first end formed with the first shape and a second end formed with at least one of the third shape and the fourth shape, wherein the second coupling segment first and second ends are circumferentially-spaced apart.

5. The method for assembling a stator ring in accordance with claim 1, wherein said providing a second plurality of segments further comprises providing the second plurality of segments such that each segment of the second plurality of segments includes a first end with the third shape and a second end with the fourth shape, wherein the first and second ends of each segment of the second plurality of segments are circumferentially-spaced apart.

6. The method for assembling a stator ring in accordance with claim 1, wherein said circumferentially coupling further comprises:

circumferentially coupling the first plurality of segments together; and circumferentially coupling the second plurality of segments together.

7. A stator ring for use in a compressor, said stator ring comprising:

a first plurality of segments that includes at least a first segment including a first end formed with a first shape and a second end formed with a second shape that is complementary to said first shape, wherein the first segment first and second ends are circumferentially-spaced apart, and wherein said first plurality of segments are configured to be circumferentially-coupled together; and a second plurality of segments that includes at least a second segment including a first end with a third shape and a second end with a fourth shape that is complementary to said third shape, wherein the second segment first and second ends are circumferentially-spaced apart, and wherein said second plurality of segments are configured to be circumferentially-coupled together, wherein each of the first, second, third, and fourth shapes facilitate Murphy-proofing the assembly of the stator ring.

8. The stator ring assembly in accordance with claim 7, wherein said first plurality of segments further comprises a first coupling segment including a first end formed with at least one of said third shape and said fourth shape and a second end formed with said second shape, wherein the first coupling segment first and second ends are circumferentially-spaced apart.

9. The stator ring assembly in accordance with claim 8, wherein said first plurality of segments further comprises a second coupling segment including a first end formed with said first shape and a second end formed with at least one of said third shape and said fourth shape, wherein the second coupling segment first and second ends are circumferentially-spaced apart.

10. The stator ring assembly in accordance with claim 8, wherein said second plurality of segments further comprises a second coupling segment including a first end formed with said first shape and a second end formed with at least one of said third shape and said fourth shape, wherein the second coupling segment first and second ends are circumferentially-spaced apart.

11. The stator ring assembly in accordance with claim 7, wherein each segment of said second plurality of segments includes a first end with said third shape and a second end with said fourth shape, wherein the first and second ends of each segment of the second plurality of segments are circumferentially-spaced apart.

12. The stator ring assembly in accordance with claim 7, wherein said first shape is substantially similar to said second shape.

13. The stator ring assembly in accordance with claim 7, wherein said third shape is substantially similar to said fourth shape.

14. A compressor for use in a gas turbine engine, said compressor comprising:

a compressor casing; and a stator ring coupled to said compressor casing, wherein said stator ring comprises:

a first plurality of segments that includes at least a first segment including a first end formed with a first shape and a second end formed with a second shape that is complementary to said first shape, wherein the first segment first and second ends are circumferentially-spaced apart, and wherein said first plurality of segments are configured to be circumferentially-coupled together; and a second plurality of segments that includes at least a second segment including a first end with a third shape and a second end with a fourth shape that is complementary to said third shape, wherein the second segment first and second ends are circumferentially-spaced apart, and wherein said second plurality of segments are configured to be circumferentially-coupled together, wherein each of the first, second, third, and fourth shapes facilitate Murphy-proofing the assembly of the stator ring.

15. The compressor in accordance with claim 14, wherein said first plurality of segments further comprises a first coupling segment including a first end formed with at least one of said third shape and said fourth shape and a second end formed with said second shape, wherein the first coupling segment first and second ends are circumferentially-spaced apart.

16. The compressor in accordance with claim 15, wherein said first plurality of segments further comprises a second coupling segment including a first end formed with said first shape and a second end formed with at least one of said third shape and said fourth shape, wherein the second coupling segment first and second ends are circumferentially-spaced apart.

17. The compressor in accordance with claim 15, wherein said second plurality of segments further comprises a second coupling segment including a first end formed with said first shape and a second end formed with at least one of said third shape and said fourth shape, wherein the second coupling segment first and second ends are circumferentially-spaced apart.

18. The compressor in accordance with claim 14, wherein each segment of said second plurality of segments includes a first end with said third shape and a second end with said fourth shape, wherein the first and second ends of each segment of the second plurality of segments are circumferentially-spaced apart.

19. The compressor in accordance with claim 14, wherein said first shape is substantially similar to said second shape.

20. The compressor in accordance with claim 14, wherein said third shape is substantially similar to said fourth shape.

* * * * *